US010392141B2

(12) United States Patent
Xie et al.

(10) Patent No.: US 10,392,141 B2
(45) Date of Patent: Aug. 27, 2019

(54) BAG FORMING DEVICE AND PACKAGING MACHINE COMPRISING THE SAME

(71) Applicant: Dongguan Foison Packing Machinery Co., Ltd., Dongguan (CN)

(72) Inventors: Wanpeng Xie, Guangzhou (CN); Libo Su, Guangzhou (CN); Pengcheng Xie, Guangzhou (CN)

(73) Assignee: DONGGUAN FOISON PACKING MACHINERY CO., LTD., Dongguan (CN)

( * ) Notice: Subject to any disclaimer, the term of this patent is extended or adjusted under 35 U.S.C. 154(b) by 762 days.

(21) Appl. No.: 14/419,858

(22) PCT Filed: Nov. 4, 2013

(86) PCT No.: PCT/CN2013/086496
§ 371 (c)(1),
(2) Date: Feb. 5, 2015

(87) PCT Pub. No.: WO2015/058424
PCT Pub. Date: Apr. 30, 2015

(65) Prior Publication Data

US 2016/0023789 A1 Jan. 28, 2016

(30) Foreign Application Priority Data

Oct. 23, 2013 (CN) ..... 2013 1 0504740

(51) Int. Cl.
*B65B 9/20* (2012.01)
*B65B 65/00* (2006.01)
(Continued)

(52) U.S. Cl.
CPC ..... *B65B 9/20* (2013.01); *B65B 41/10* (2013.01); *B65B 41/16* (2013.01); *B65B 65/006* (2013.01); *B65B 9/22* (2013.01); *B65B 2220/06* (2013.01)

(58) Field of Classification Search
CPC .. B65B 9/20; B65B 9/22; B65B 41/10; B65B 41/16; B65B 65/006; B65B 2220/06; B65B 9/207; B65B 9/213
(Continued)

(56) References Cited

U.S. PATENT DOCUMENTS 2,831,302 A * 4/1958 Jensen ..... A22C 11/104 53/138.4
3,256,673 A * 6/1966 Tew ..... B65B 9/2042 53/551
(Continued)

FOREIGN PATENT DOCUMENTS

CN 1200703 A 12/1998
CN 203568015 U 4/2014

*Primary Examiner* — Alexander M Valvis
*Assistant Examiner* — Eduardo R Ferrero

(57) ABSTRACT

A bag forming device and a bag machine are provided. The bag forming device comprises at least two bag forming units, wherein each bag forming unit comprises a deflection element and a folding element, and the forming tubes of the folding elements are arranged in a first direction in sequence. The packaging film is moved in a moving route when moving through the deflection element, and film moving positions are provided in the deflection element in the moving route for passing through of the packaging film to make deflection of the packaging film. The present invention reasonably adjusts the moving direction of the packaging films, and the direction of the longitudinal openings of the packaging films after longitudinal folding. When it is used in a multirow packaging machine, simultaneous bag pulling, longitudinal sealing, transversal sealing and cutting of the
(Continued)

respective packaging film straps can be achieved, by reasonable cooperation of the bag pulling unit, the transversal sealing unit, the longitudinally sealing unit, and the cutting unit, without providing any synchronous control device, and thus solves the problem of complicated structure and high manufacturing cost in multirow packaging machine.

14 Claims, 11 Drawing Sheets

(51) Int. Cl.
*B65B 41/16* (2006.01)
*B65B 41/10* (2006.01)
*B65B 9/22* (2006.01)

(58) Field of Classification Search
USPC ..... 53/546, 551
See application file for complete search history.

(56) References Cited

U.S. PATENT DOCUMENTS 3,973,474 A * 8/1976 Auckenthaler ..... B65B 1/02 493/197
4,107,900 A 8/1978 Izumi
4,117,647 A * 10/1978 Rossi ..... B65B 9/20 177/60
4,136,505 A * 1/1979 Putnam, Jr. ..... B65B 9/20 53/551
4,512,138 A * 4/1985 Greenawalt ..... B29C 65/02 219/243
4,576,588 A * 3/1986 Umeda ..... B65B 9/22 493/302
4,640,409 A * 2/1987 Holtman ..... B65H 5/062 198/624
4,757,668 A * 7/1988 Klinkel ..... B29C 65/02 53/374.6
4,896,808 A * 1/1990 Schaede ..... B41F 13/025 226/42
5,046,300 A * 9/1991 Custer ..... B29C 65/7855 156/66
5,174,096 A * 12/1992 Fukuda ..... B65B 9/20 226/19
5,235,794 A * 8/1993 Center ..... B29C 66/83413 53/202
5,237,798 A * 8/1993 Fukuda ..... B65B 9/20 53/389.4
5,425,216 A * 6/1995 Ausnit ..... B65B 9/20 53/139.2
5,524,418 A * 6/1996 Thompson ..... A22C 13/00 53/411
5,680,979 A * 10/1997 Weis ..... B41F 13/02 226/111
5,756,979 A * 5/1998 Murakami ..... B26D 5/34 235/454
5,845,465 A * 12/1998 Bennett ..... B65B 9/20 53/374.3
6,006,501 A 12/1999 Davis et al.
6,200,249 B1 * 3/2001 Fukuda ..... B65B 9/20 493/186
6,428,457 B1 * 8/2002 Fukuda ..... B65B 9/20 493/302
6,497,405 B2 * 12/2002 Yu ..... B65H 3/0676 271/116
6,810,812 B2 * 11/2004 Fischer ..... B41F 13/025 101/216
6,813,871 B2 * 11/2004 Kurth ..... B65B 9/213 53/551
6,874,299 B2 * 4/2005 Basque ..... B65B 9/20 53/154
7,003,929 B2 * 2/2006 Laplace ..... B65B 9/22 493/302
7,028,451 B2 * 4/2006 Braun ..... B65B 59/04 53/550
7,076,935 B2 * 7/2006 Basque ..... B29C 65/18 53/545
8,656,690 B2 * 2/2014 Bierschenk ..... B65B 1/22 53/437
9,284,075 B2 * 3/2016 Bierschenk ..... B65B 1/00
2002/0084573 A1 * 7/2002 Yu ..... B65H 3/0676 271/116
2002/0177380 A1 * 11/2002 Forman ..... B29C 66/8221 442/366
2003/0163979 A1 * 9/2003 Kurth ..... B65B 9/213 53/551
2010/0180554 A1 * 7/2010 Rapparini ..... B65B 9/20 53/545
2013/0152509 A1 * 6/2013 Bierschenk ..... B65B 1/00 53/437
2015/0020483 A1 * 1/2015 Di Fede ..... B65B 41/16 53/551

* cited by examiner

BAG FORMING DEVICE AND PACKAGING MACHINE COMPRISING THE SAME

FIELD OF THE INVENTION

The present invention relates to the field of packaging machines, and in particular, to a bag forming device and a packaging machine comprising the same.

BACKGROUND OF THE INVENTION

As shown in FIGS. 1(A)-1(C) and 2(A)-2(C), sealing means for packaging generally includes three-side-sealing (such as shown in FIGS. 1(A) and 2(A)), four-side-sealing (such as shown in FIGS. 1(B) and 2(B)), and back-side-sealing (such as shown in FIGS. 1(C) and 2(C)). Multirow three-side-sealing packaging machine has high automation and high efficiency, and therefore has become very popular. Traditional multirow three-side-sealing packaging machine comprises a film feeding unit, a dividing unit, a content feeding unit, a bag forming unit, a bag pulling unit, a longitudinally sealing unit, a transversally sealing unit and a cutting unit. The bag forming unit, as an important part of the packaging machine, has direct influence on the capability and performance of the packaging machine.

Patent application No. CN 96197906.2 disclosed a packaging machine with forming tube around which a ribbon of flexible material is wrapped, in order to shape a continuous sleeve, longitudinally sealed to obtain, with subsequent transversal sealings, filled and sealed packages, wherein it is equipped with a shaping device that produces on said sleeve, along the part between two transversal subsequent sealings, a gusset that is able to constitute the bottom structure of the package, that will have, when turned and placed over a horizontal ground, the necessary base to stand-up steadily in vertical position.

In this disclosure, the packaging film is provided to the forming tube directly from its rear. When the packaging machine is a multirow three-side-sealing packaging machine, i.e, when it has multiple forming tubes arranged in a first direction in sequence, one packaging film is divided into multiple packaging film straps simultaneously by the dividing unit, after which each of the multiple packaging film straps is provided to a respective forming tube from its rear, and then folded longitudinally. At this time, as shown in FIG. 3, longitudinal openings of the packaging films are facing a second direction that is perpendicular to the first direction, i.e., facing the front of the forming tube 1. Subjected to the folding direction and the longitudinal opening direction of the packaging films, it is necessary to provided a separate set of bag pulling unit, longitudinally sealing unit, transversally sealing unit and cutting unit for each of the packaging film straps, so as to carry out bag pulling, longitudinally sealing, transversally sealing and cutting. This makes it very hard for the multirow packaging machine to accomplish simultaneous bag pulling, longitudinally sealing, transversally sealing and cutting.

Since each separate bag pulling unit comprises two spindles and bag pulling rollers arranged on the spindles, it is necessary to provide synchronous control devices on all the spindles to ensure their synchronous operation, and therefore synchronous rotation of each pair of the bag pulling rollers, so as to achieve synchronous pulling of the multiple packaging films in the multirow packaging machine. For the same reason, it is necessary to provide corresponding synchronous control devices to achieve the longitudinally sealing, transversally sealing and cutting of the multiple packaging film straps. This leads to a complicated structure and high manufacturing cost of the packaging machine.

SUMMARY OF THE INVENTION

To overcome the above disadvantages in prior art, the present invention provides a bag forming device, which can solve the complicated structure and high manufacturing cost problem that is caused in achieving simultaneous bag pulling, longitudinally sealing, transversally sealing and cutting of multiple packaging film straps.

The present invention also provide a packaging machine.

A bag forming device is provided by the present invention, comprising at least two bag forming units, each bag forming unit being provided for passing through of a packaging film strap, wherein each bag forming unit comprises a deflection element and a folding element, the folding element comprises a forming tube, and the forming tubes of the bag forming units are arranged in a first direction in sequence.

In one bag forming unit, the deflection element, the folding element and the forming tubes operates as follows.

For the deflection element, the packaging film is moved from rear of the deflection element to front of the deflection element, and when the packaging film is moved around the deflection element, the packaging film moves along the following moving route: from front of the deflection element, to one side end of the deflection element, to the other side end of the deflection element that is close to the forming tube, and then moves downward, wherein said two side ends are left side end and right side end of the deflection element and are distributed in width direction of the deflection element, the width direction of the deflection element is in consistence with the first direction X, and film moving positions are provided in the deflection element in the moving route for passing through of the packaging film to make deflection of the packaging film, For the folding element, when the packaging film is moving through the folding element, the packaging film is folded longitudinally, and longitudinal openings of the packaging films after longitudinal folding all face towards the first direction, and the packaging film moves along an axial direction of the forming tube when the packaging film is moving through the forming tube.

The deflection element comprises a first transition element, an inclined transition portion that is arranged above the first transition element, and a second transition element. The front end surface of the inclined transition portion is an inclined transition surface which is in a inclined arrangement, the film moving positions include the inclined transition surface, an outer side surface of the first transition element, and an outer side surface of the second transition element, for successive passing of the packaging film. Said outer side surface of the second transition element and said outer side surface of the first transition element are distributed in the width direction of the deflection element. From a side end of the inclined transition surface that is close to the outer side surface of the first transition element, to a side end of the inclined transition surface that is close to the outer side surface of the second transition element, the inclined transition surface gradually leans backward.

An orthographic projection of the outer side surface of the first transition element in a reference surface formed by the first direction and a second direction is defined as a first projection, and an orthographic projection of the inclined transition surface in said reference surface is defined as a second projection, and an outer side edge of the first projection is located on one side of the second projection. The height direction of the deflection element is perpendicular to the first direction, and the second direction is perpendicular to both the first direction and the height direction of the deflection element.

The second transition element and the first transition element are both extended in the second direction, the height direction of the deflection element is perpendicular to the first direction, and the second direction is perpendicular to both the first direction and the height direction of the deflection element. The inclined transition portion, the first transition element and the second transition element are arranged in sequence from up to down.

The bag forming device comprises at least two deflection plates arranged in the first direction; deflection elements are disposed at both sides of each of the deflection plates in the first direction; inclined transition portions are formed on the deflection plate with inclined transition surfaces symmetrically distributed; the deflection plates and corresponding two deflection elements jointly form a deflection unit, and all deflection units are arranged in the first direction with any of two adjacent units staggered placed in height direction; forming tubes corresponding to two deflection elements in the same deflection unit are arranged on an adjacent side of the two deflection elements.

The deflection elements are arranged in the first direction in sequence, and two adjacent deflection elements are staggered in height direction.

The bag forming device further comprises a path adjustment mechanism, and the packaging film passes through the path adjustment mechanism before fed into the bag forming mechanism; the path adjustment mechanism comprises a bracket, a stationary roller disposed on the bracket, and a movable roller movably disposed on the bracket; and the stationary roller is extended in the first direction.

The folding unit further comprises two limiting members; the limiting members have symmetrically distributed film passages; the film passages includes an arc-shaped groove and a bar-shape position-limiting portion communicative with the arc-shaped groove; and the position-limiting portion is extended in the first direction.

A packaging machine is also provided by the present invention, comprising a film feeding unit, a dividing unit, a content feeding unit, a bag pulling unit, a longitudinally sealing unit, a transversally sealing unit, a cutting unit, and the bag forming device as described above, wherein the film feeding unit, the dividing unit, the bag forming device, the bag pulling unit, the longitudinally sealing unit, the transversally sealing unit, and the cutting unit are located in sequence along the feeding direction of the film, and the content feeding unit is used to feed the content to the forming tube of the bag forming device.

The bag pulling unit comprises two parallel spindles, at least two roller assemblies corresponding to each of the bag forming mechanism, and an actuator; the spindles have axis in the first direction; each of the roller assemblies has two bag pulling rollers and one compensating roller in contact with one of the bag pulling rollers; the actuator is used to actuate the rotations of the compensating roller and the spindles; each of the bag pulling rollers is mounted to the corresponding spindle via a one-way bearing; and the film, after folded, passes between the two bag pulling rollers and is actuated to move downward by the two bag pulling rollers.

The present invention reasonably adjusts the moving direction of the packaging films, and the direction of the longitudinal openings of the packaging films after longitudinal folding. When it is used in a multirow packaging machine, simultaneous bag pulling, longitudinal sealing, transversal sealing and cutting of the respective packaging films can be achieved, by reasonable cooperation of the bag pulling unit, the transversal sealing unit, the longitudinally sealing unit, and the cutting unit, without providing any synchronous control device. Therefore, it solves the problem of complicated structure and high manufacturing cost in multirow packaging machine that is caused by the synchronous control devices in achieving simultaneous bag pulling, longitudinally sealing, transversally sealing and cutting of multiple packaging films.

BRIEF DESCRIPTION OF THE DRAWINGS

FIG. 1A-FIG. 1C show various packaging bags utilizing different sealing means in prior art, wherein FIG. 1A shows a three-side-sealing, FIG. 1B shows a four-side-sealing, and FIG. 1C shows a back-side-sealing.

LIST OF REFERENCE NUMBERS

8 packaging film; 81 longitudinal opening; 10 deflection element; 11 inclined transition portion; 111 inclined transition surface; 12 first transition element; 121 outer side surface of the first transition element; 13 second transition element; 131 outer side surface of the second transition element; 31 forming tube; 32 limiting member; 321 film passage; 40 path adjustment mechanism; 41 stationary roller; 42 movable roller; 50 deflection unit; 91 bag pulling roller; 92 compensating roller; 93 spindle; 94 one-way bearing; 100 bag forming device; 200 film feeding unit; 300 dividing unit; 400 bag pulling unit; 500 longitudinally sealing unit; 600 transversally sealing unit; 700 cutting unit.

DETAILED DESCRIPTION OF THE INVENTION

The spirit of the present invention will be apparent and elucidated from the following detailed description of specific examples, reference being made to the accompanying drawings.

FIGS. 4 to 9 show a bag forming device of the present invention, which comprises at least two bag forming units. Each bag forming unit is provided for passing of a separate packaging film strap, therefore each bag forming unit is provided for passing of each separate packaging film 8 in the packaging machine. Each bag forming unit comprises a deflection element 10 and a folding element for successive passing of each corresponding packaging film 8. The folding element comprises a forming tubes 31, and as shown in FIGS. 6, 7, 8 and 9, the forming tubes 31 of the bag forming units are arranged in a first direction X in sequence.

One of the bag forming units will now be described in detail.

Figure 1:
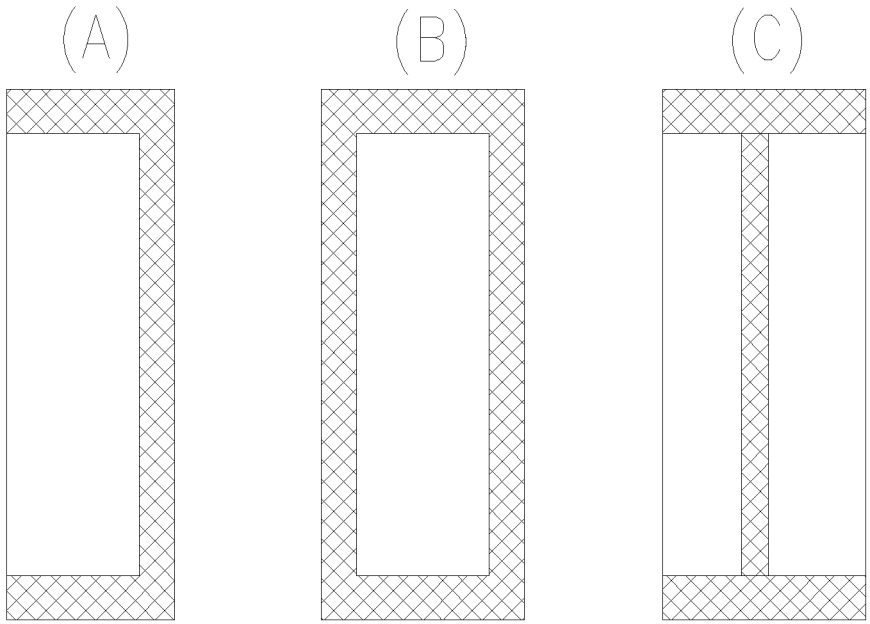
PRIOR ART FIG. 1
Figure 2:
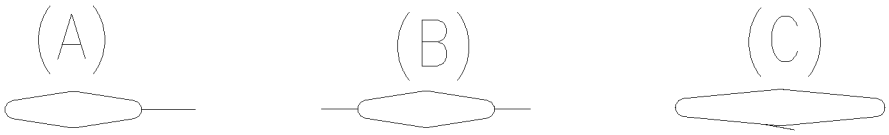
PRIOR ART FIG. 2
FIG. 2A-FIG. 2C show a top view of the packaging bags in FIG. 1A-FIG. 1C, wherein 2A shows a top view of three-side-sealing, 2B shows a top view of four-side-sealing, and 2C shows a top view of back-side-sealing.
Figure 3:
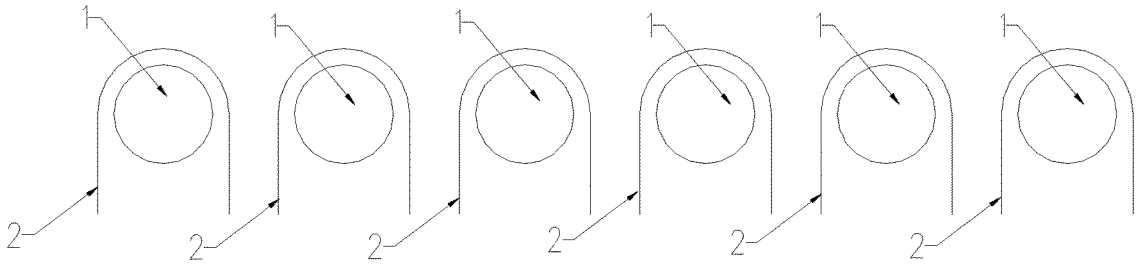
PRIOR ART FIG. 3
FIG. 3 shows longitudinal openings of the packaging films of the packaging machine disclosed in patent application No. CN 96197906.2.
Figure 4:
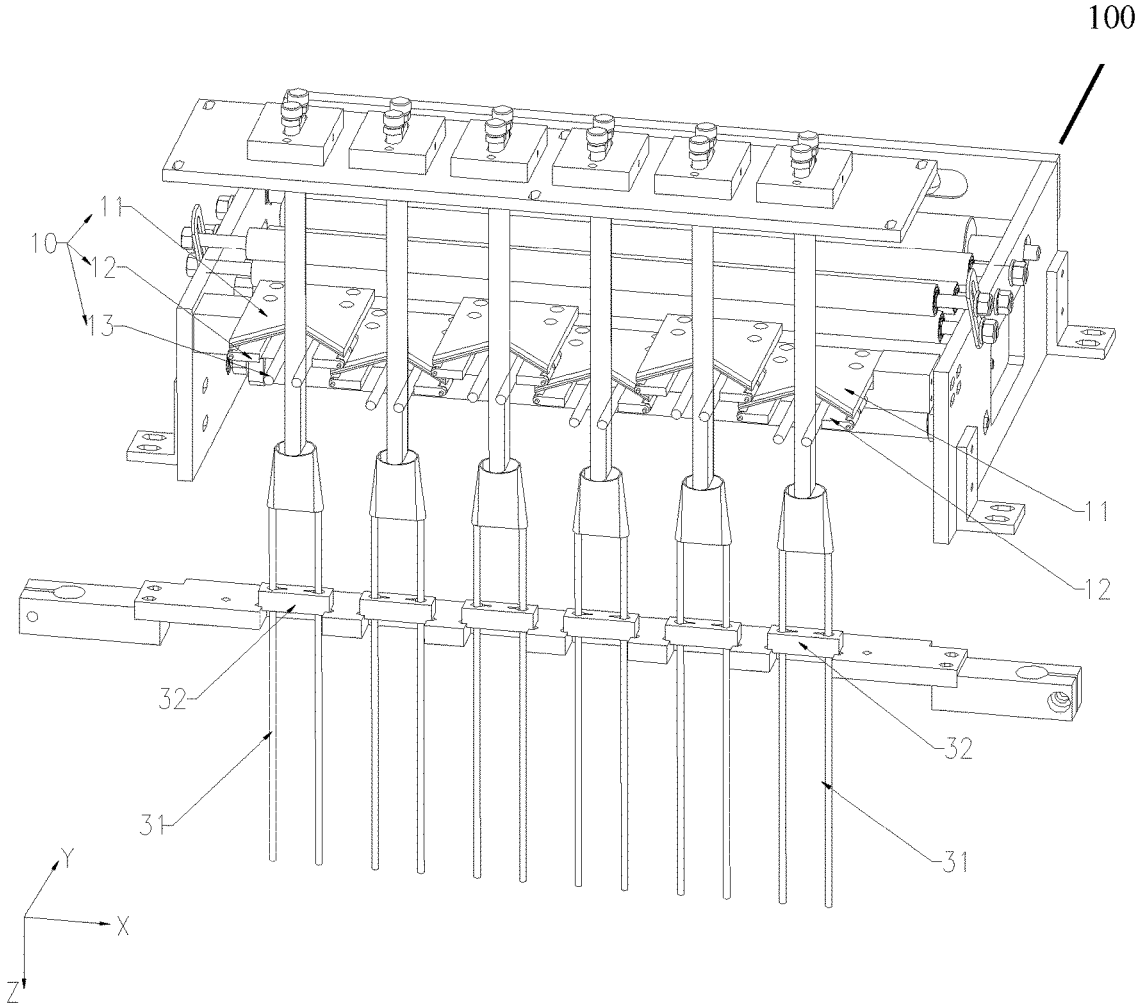
FIG. 4 shows the structure of the bag forming device of the present invention.
Figure 5:
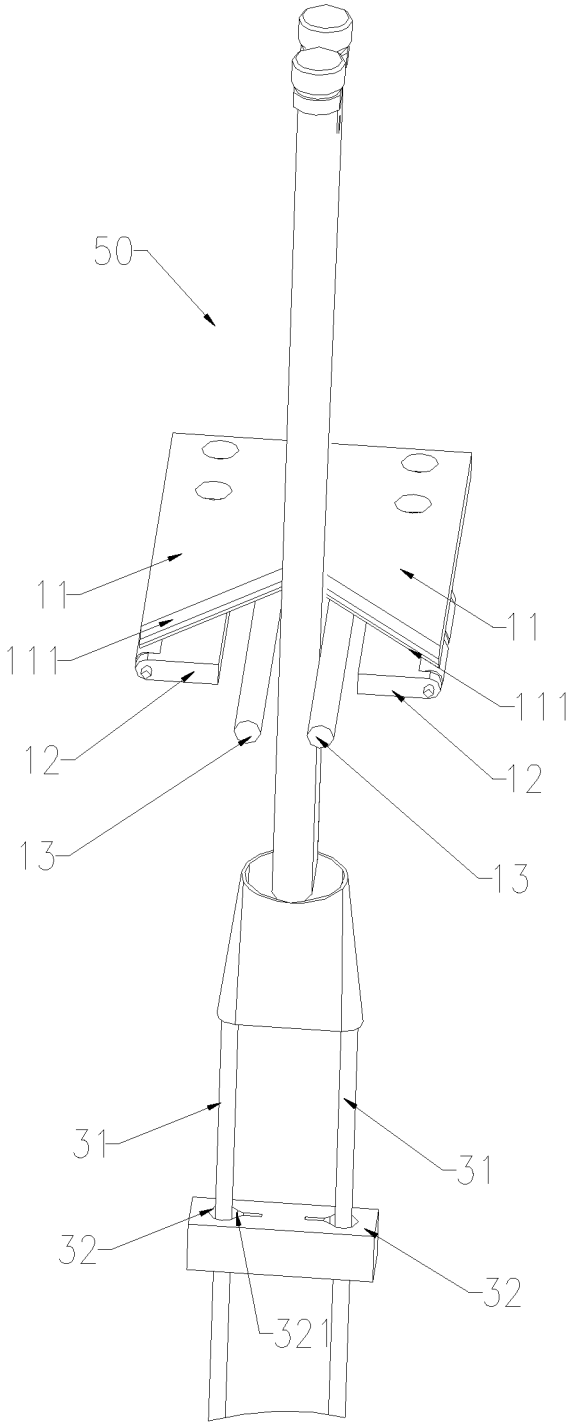
FIG. 5 shows the structure of a bag forming unit in FIG. 4.
Figure 6:
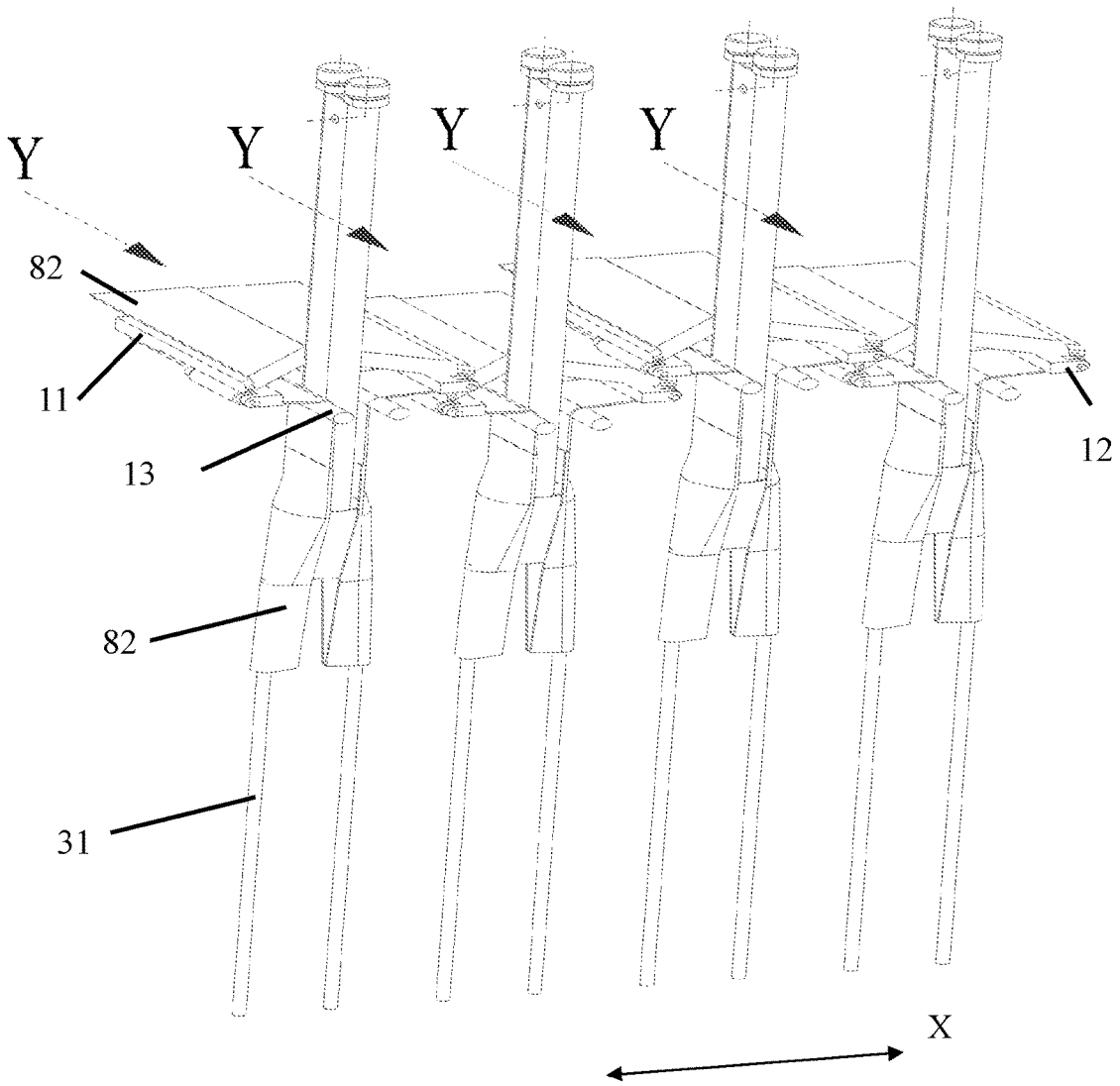
FIG. 6 shows the moving direction of each packaging film in the bag forming device.

FIGS. 5 and 6 show the deflection element 10, the folding element and the forming tubes 31 in the folding element, which are comprised in the same bag forming unit.

The packaging film 8 is fed from the rear of the deflection element 10 to the front of the deflection element 10. When the packaging film 8 is moving around the deflection element 10, it follows the following route: from the front of the deflection element 10, to one side end of the deflection element 10, to the other side end of the deflection element 10 that is close to the forming tube 31, and then moves downward.

Said two side ends are left side end and right side end of the deflection element 10 and are distributed in width direction of the deflection element 10, wherein the width direction of the deflection element 10 is in consistence with the first direction X. The two side ends only need to be distributed in the width direction of the deflection element 10, and the height position of the two side ends can be the same or not. In a preferable embodiment, the two side ends are staggered in height direction. The shapes of the two side ends can be the same or not, depending on actual requirement.

Film moving positions are provided in the deflection element 10, which are provided along the moving route of the film and for the bypassing and turning of the packaging film 8.

When the downward moving packaging film 8 is passing the folding element, the packaging film 8 is folded longitudinally into a U shape. Longitudinal openings 81 of the packaging films 8 after longitudinal folding all face towards the first direction X. The downward moving packaging film 8 is moved along the axial direction of the shaping tube 31 when it is passing the shaping tube 31.

Figure 7:
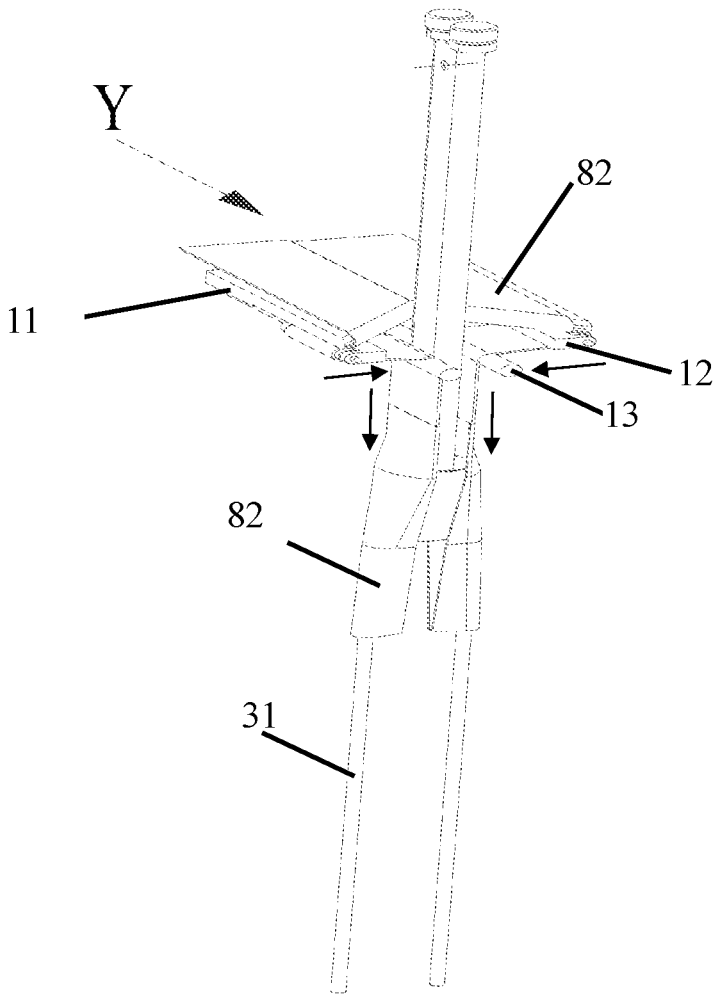
FIG. 7 shows the moving direction of the packaging film in a bag forming unit in FIG. 6.

As shown in FIGS. 6 and 7, when the bag forming device 100 is used in a multiraw three-side-sealing packaging machine, one packaging film 8 will be divided into packaging film straps 82 by the dividing unit 300. Before operation, one end of each of the packaging films straps 82 is firstly wrapped on the deflection element 10 along the above moving route from the rear of the deflection element 10, and folded longitudinally on the corresponding folding element. During the continuous feeding of each packaging film 8, the fed part of each packaging film strap 8 is fed from the rear of the deflection element 10 and toward the deflection element 10, and then moved along the above moving route around the deflection element 10, and then moved downward to the folding element and folded longitudinally. The longitudinal openings 81 of the packaging films 8 after longitudinal folding all face towards the first direction X.

In the present invention, by reasonably adjusting the moving direction of the packaging films 8, the longitudinal openings 81 of the packaging films 8 after longitudinal folding all face towards the first direction X. Therefore when the bag forming device 100 is used in a multirow packaging machine, by said direction of the longitudinal openings 81 of the packaging films 8, two spindles of the bag pulling unit 400 of the packaging machine can be positioned transversely. In other words, the extending direction of the spindles is in consistence with the first direction X. Therefore, the bag pulling rollers 91 of all the bag forming units can share the same two spindles. The multiple pairs of rollers on the spindles can be rotated simultaneously with the rotation of the two spindles, such that all the packaging films 8 can be pulled simultaneously.

Similarly, by said direction of the longitudinal openings 81 of the packaging films 8, two supporting bodies for longitudinal sealing of the longitudinally sealing unit 500 can be positioned transversely. Thus heating bodies for longitudinal sealing of corresponding bag forming units can share the two supporting bodies. With the rotation of the supporting bodies, longitudinal sealing can be performed by the multiple heating bodies, which are on the supporting bodies, to the packaging films 8.

Similarly, by said direction of the longitudinal openings 81 of the packaging films 8, two supporting bodies for transversal sealing of the transversally sealing unit 600 can be positioned transversely. Thus heating bodies for transversal sealing of corresponding bag forming units can share the two supporting bodies. With the rotation of the supporting bodies, transversal sealing can be performed by the multiple heating bodies, which are on the supporting bodies, simultaneously to the packaging films 8.

Similarly, by said direction of the longitudinal openings 81 of the packaging films 8, two knife supporting bodies of the cutting unit 700 can be positioned transversely. Thus knife pairs of corresponding bag forming units can share the two knife supporting bodies. With the rotation of the two knife supporting bodies, cutting can be performed by the multiple knife pairs, which are on the knife supporting bodies, simultaneously to the packaging films 8.

Therefore, when the present invention is utilized in a multirow packaging machine, bag pulling, longitudinal sealing, transversal sealing and cutting can be performed simultaneously to the packaging films 8 in respective rows of the three-side packaging machines, by the action of the bag pulling unit 400, the transversal sealing unit 600, the longitudinally sealing unit 500, and the cutting unit 700, without providing any synchronous control device. By this way, complicated structure and high manufacturing cost in multirow packaging machine can be efficiently avoided.

Since the structures of the bag pulling unit 400, the transversal sealing unit 600, the longitudinally sealing unit 500, and the cutting unit 700 are all well known in the art, they are not described in detail in the above text. Instead, the present disclosure focuses on the regulating of the longitudinal openings 81 of the packaging films 8, which allows simultaneous bag pulling, longitudinal sealing, transversal sealing and cutting of the respective packaging films 8, by reasonable cooperation of the bag pulling unit 400, the transversal sealing unit 600, the longitudinally sealing unit 500, and the cutting unit 700, without providing any synchronous control device.

The shape of the forming tube 31 can be determined depending on actual requirement. For example, the shape can be a hollow circular cylinder or a flat shape, and of course, the forming tube 31 can be in other shapes. In an exemplary embodiment, the forming tube comprises two first surface walls, wherein the ends of the two first surface walls are connected respectively by two first side walls. The distance between the two first surface walls becomes smaller from up to down, and the two first side walls are arranged in the two ends of the forming tube 31 in the first direction, facilitating the shaping of the packaging films 8.

When the packaging film 8 is passing through the forming tube 31, the packaging film 8 is wrapped around the outer surface of the forming tube 31, forming a longitudinal folding. Preferably, the folding element further comprises a limiting member 32 which is provided with a film passage 321. The film passage 321 comprises an arc-shaped groove for passing through of the forming tube 31, and a bar-shape position-limiting portion communicative with the arc-shaped groove. The position-limiting portion is extended in the first direction X.

In operation, the packaging film 8 is first longitudinally folded and put within the film passage 321, wherein the middle part of the packaging film 8 is wrapped around the outer surface of the forming tube 31, while the two sides of the packaging film 8 is in the position-limiting portion. With the continuous feeding of the packaging film 8, all the packaging films 8 that have passed the limiting member 32 are longitudinally folded into a U shape. Therefore, the design of the limiting member 32 allows the longitudinal folding of the packaging film 8 to be more smooth and accurate, facilitating subsequent longitudinal folding.

Preferably, a forming surface can be provided above the forming tube 31. The forming surface may comprise two second surface walls, and two side walls connected between the two surface walls. The distance between the two second surface walls becomes smaller from up to down, and the two second side walls are arranged in the ends of the forming surface in the first direction, facilitating the shaping of the packaging films 8.

To facilitate the feeding of materials, the forming tube 31 can either be directly connected to the feeding unit, or be connected to the feeding unit via a feeding cylinder, so as to help transportation of materials from the feeding unit to the forming tube 31. The forming surface can also be formed on the feeding cylinder.

Figure 9:
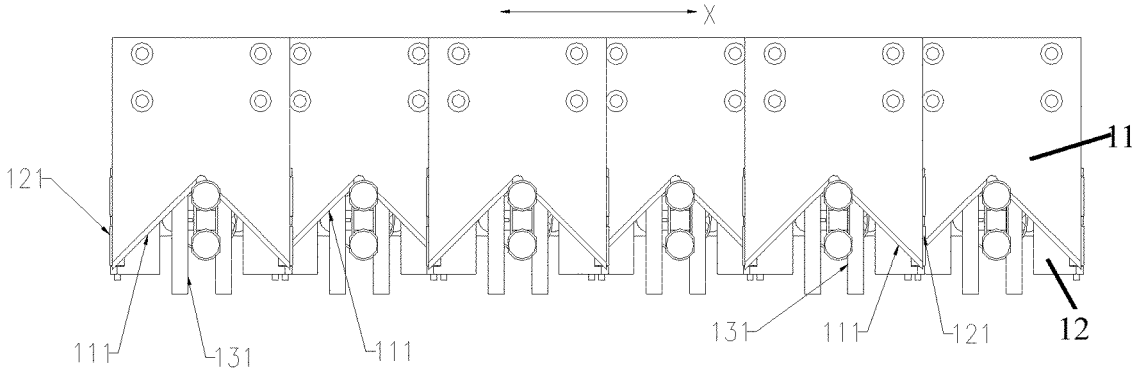
FIG. 9 shows a projected view of each deflection assembly in a reference plane.

In order to allow the packaging film 8 move in the above route, i.e., from the front of the deflection element 10, to one side end of the deflection element 10, to the other side end of the deflection element 10 that is close to the forming tube 31, and then moves downward, specific structure can be provided for the deflection element 10. As shown in FIGS. 5 and 9, the deflection element 10 comprises a first transition element 12, an inclined transition portion 11 that is arranged above the first transition element 12, and a second transition element 13. The front end surface of the inclined transition portion 11 is a inclined transition surface 111 which is in a inclined arrangement. The film moving positions include the inclined transition surface 111, the outer side surface 121 of the first transition element, and the outer side surface 131 of the second transition element, for successive passing of the packaging film 8.

The outer side surface of the second transition element 13 and the outer side surface of the first transition element 12 for passing of the packaging film 8 are distributed in the width direction of the deflection element 10. And they only need to be distributed in the width direction of the deflection element 10, and their height position can be the same or not. In a preferable embodiment, the two outer side surfaces are staggered in height direction.

As shown in FIG. 5, from the side end of the inclined transition surface 111 that is close to the outer side surface of the first transition element 12, to the side end of the inclined transition surface 111 that is close to the outer side surface of the second transition element 13, the inclined transition surface 111 gradually leans backward. According to common general knowledge, the side of the second transition element 13 that is adjacent to the first transition element 12 is the inner side, and the other side is the outer side.

Preferably, the second transition element 13 is parallel to the first transition element 12, and they are all extended in the second direction Y. The height direction Z of the deflection element 10 is perpendicular to the first direction X, and the second direction Y is perpendicular to both the first direction X and the height direction Z of the deflection element 10.

Preferably, the inclined transition portion 11 is also extended in the second direction Y. The inclined transition portion 11, the first transition element 12 and the second transition element 13 are arranged in sequence from up to down. As shown in FIG. 9, the orthographic projection of the outer side surface 121 of the first transition element in a reference surface formed by the first direction X and the second direction Y can be defined as a first projection, while the orthographic projection of inclined transition surface 111 in this reference surface can be defined as a second projection, and the outer side edge of the first projection is located on one side of the second projection. The size of the inclined transition surface 111 can be determined according to the width of the packaging film strap 8.

In order to reduce friction, the inclined transition surface 111 can be provided as an arc surface on the inclined transition portion 11, an arc surface on a rolling spindle of the inclined transition portion 11, or other structures. The first transition element 12 can be a fixed spindle, a rotatable spindle, a plate or other structures. Therefore the outer side surface of the first transition element 12 for passing of the packaging film 8 can be a flat surface, and preferably, can be a fixed spindle, a rotatable spindle, or an arc surface on a plate, so as to reduce friction. The second transition element 13 can be a fixed spindle, a rotatable spindle, a plate or other structures. Therefore the outer side surface of the second transition element 13 for passing of the packaging film 8 can be a flat surface, and preferably, can be a fixed spindle, a rotatable spindle, or an arc surface on a plate, so as to reduce friction.

As shown in FIG. 7, in which the arrows show the moving direction of the packaging film 8, in operation, after division of one packaging film 8 into packaging film straps 82, each of the packaging film straps 82 is transported from the rear of corresponding inclined transition portion 11 toward the inclined transition surface 111, and moved around the inclined transition surface 111, and then moved below the inclined transition portion 11 to the outer side surface 121 of the first transition element, and then moved below the first transition element 12 to the outer side surface 131 of the second transition element, and then moved downward.

A bag forming device 100 is shown in FIGS. 4, 5, 8 and 9, which comprises at least two deflection plates arranged in the first direction X in sequence. Deflection elements 10 are disposed at both sides of each deflection plate in the X direction. The inclined transition portion 11 is formed on the deflection plate with the inclined transition surface 111 symmetrically disposed and forming a V-shape.

The deflection plate and corresponding two deflection elements 10 jointly form a deflection unit. All deflection units are arranged in the X direction with any of two adjacent units 50 being staggered placed in height direction in order to avoid interference between two adjacent packaging film straps 82.

Figure 8:
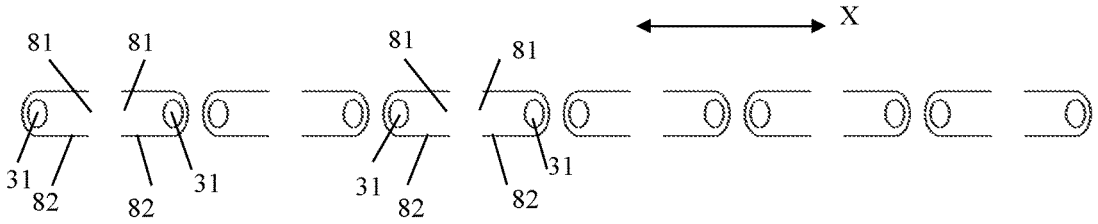
FIG. 8 shows the longitudinal openings of the packaging films which are folded longitudinally.

As shown in FIG. 8, two forming tubes 31 are arranged such that the two packaging films 8 have opposite longitudinal openings 81. In order to save costs and facilitate processing, the two limiting members 32 of the two deflection elements 10 of the same deflection unit 50 are integrally formed in a rectangular shape. In this case, the limiting members 32 have symmetrically distributed film passages 321.

The top ends of the two tubes 31 are communicative via a discharge drum on which are formed shaping surfaces for the corresponding two deflection elements 10. This design reduces space occupation while satisfying feeding requirements. Preferably, all deflection units 50 are distributed in two lines staggered in height.

Figure 10:
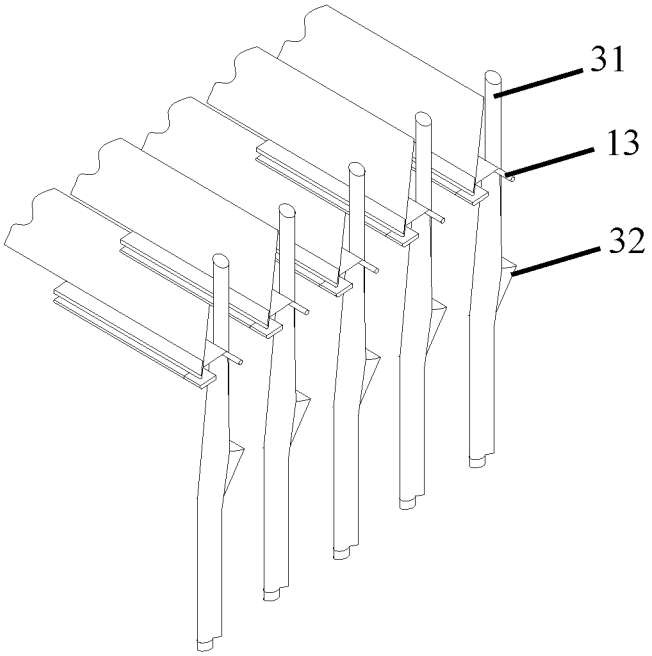
FIG. 10 shows the structure of another bag forming device of the present invention.
Figure 11:
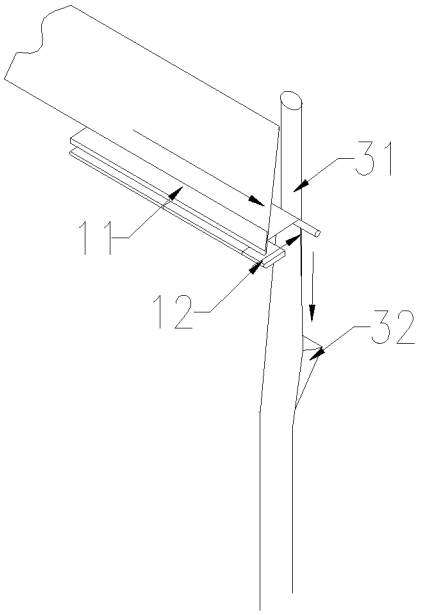
FIG. 11 shows the structure of a bag forming unit in FIG. 10.

The arrangement of the bag forming device is not limited to those as described above. FIGS. 10 and 11 show an alternative arrangement, wherein the arrows in FIG. 11 indicate the flow direction of a single packaging film strap 8. In this arrangement, each of the longitudinally folded films 8 has an opening facing toward the same direction, i.e., toward either the right side or the left side. Preferably, all deflection elements 10 are distributed in two lines staggered in height.

Figure 12:
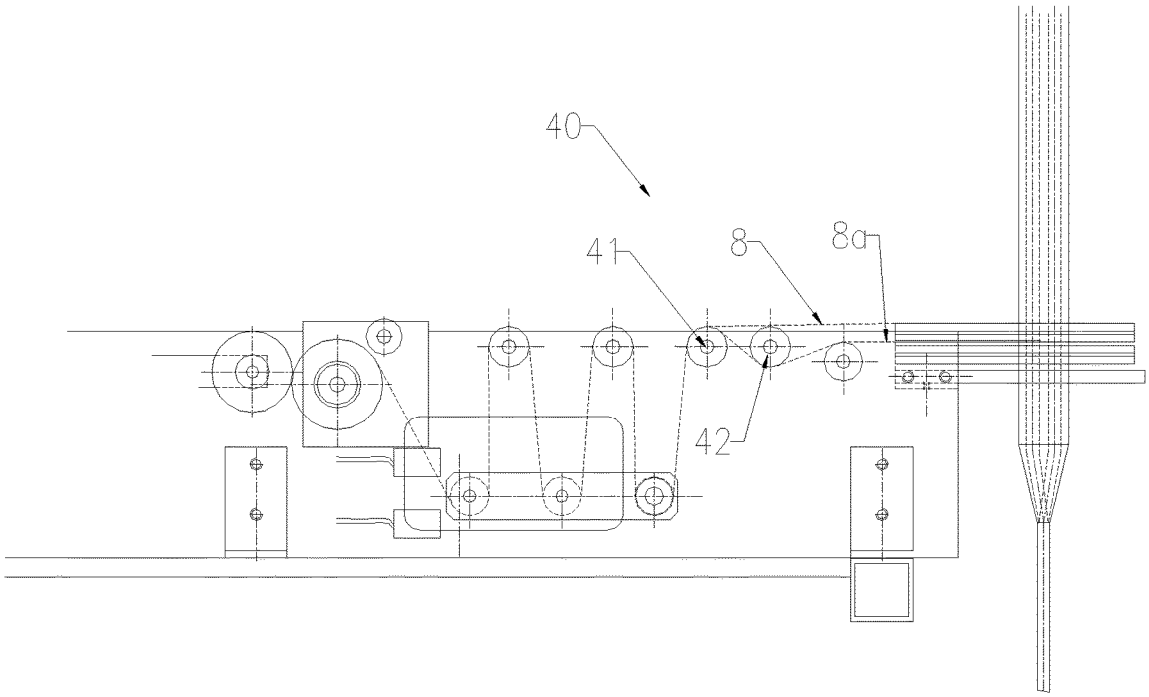
FIG. 12 shows the structure of the length adjustment mechanism in the bag forming device of the present invention.

As shown in FIG. 12, the bag forming device 100 further comprises a path adjustment mechanism 40. The film 8 firstly passes through the path adjustment mechanism 40 before flowing into the bag forming mechanism. The path adjustment mechanism 40 comprises a bracket, a stationary roller 41 disposed on the bracket, and a movable roller 42 movably disposed on the bracket. The stationary roller 41 is extended in the X direction.

By selectively wrapping the film 8 around the stationary roller 41, or both the stationary roller 41 and the movable roller 42, the differences in lengths among the path of each film 8 as caused due to the staggered arrangement of the deflection elements 10 can be compensated.

For example, when the films 8 have printed pattern which needs concise sealing and cutting, a film 8 is directly wound to the deflection unit 50 through the stationary roller 41, while a film 8*a* is first wound to the stationary roller 41 and then to the movable roller before wound to the deflection unit 50. By adjusting the position of the movable roller 42, the distances from the mechanism 40 to the tube 31 for the films 8 and 8*a* can keep same so that the films may be concisely sealed and cut. The number of the movable roller 42 can be determined by the arrangement of the movable roller 42. When all the deflection units 50 or all the deflection elements 10 are arranged in two lines staggered in height, the number of the movable roller 42 can only be one in order to save costs.

The bracket is provided with a long groove along which the movable roller 42 is attached at different positions by fasteners, such that the movable roller 42 is movably mounted on the bracket. The long groove may extend in height direction, horizontally or slantly such that the movable roller 42 is able to move in height direction, horizontally or slantly. Of course, the movable roller 42 can be attached to the long groove by other methods such as a snap joint.

In operation, each packaging film strap 8 is fed from the rear of each deflection element 10 toward the deflection element 10 and folded by each folding unit. Each of the bag forming mechanisms is operated similarly as follows. The packaging film 8 passes through the path adjustment mechanism 40, the deflection element 10, and the folding unit in sequence. As the film 8 advances the remaining portion of the film 8 is fed to the path adjustment mechanism 40, and then deflected via the deflection element 10, and finally longitudinally folded via the folding unit.

The bag forming device 100 is applicable to various packaging machines and primarily to a vertical type multirow three-side-sealing packaging machine. The bag forming device 100 can also be used with a vertical type multirow four-side-sealing packaging machine, where the two longitudinal ends of the bag already longitudinally folded, i.e., the longitudinal end having the opening 81 and the opposite closed end, need to be sealed.

Figure 13:
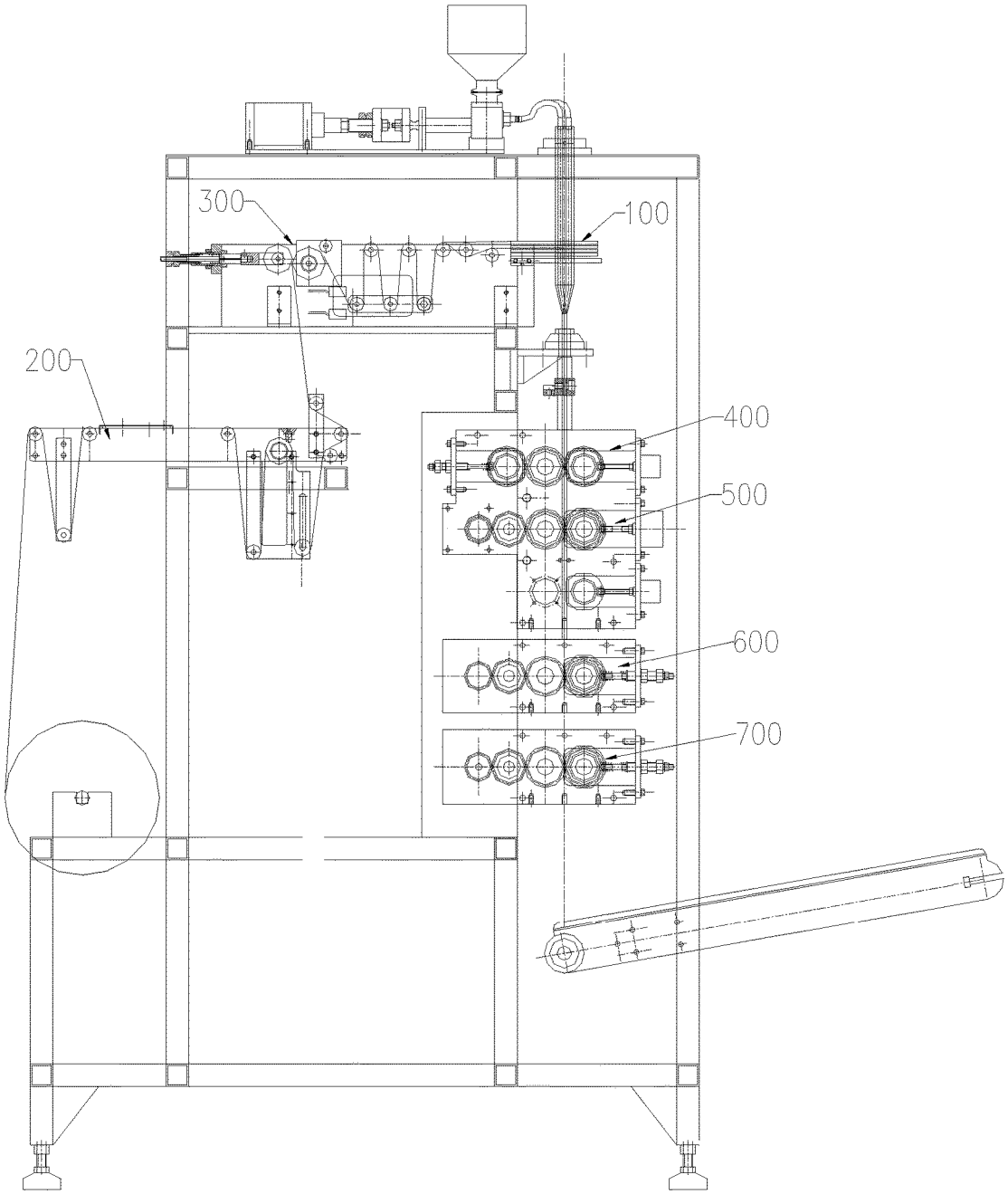
FIG. 13 shows the structure of the packaging machine of the present invention.

FIG. 13 shows a packaging machine comprising a film feeding unit 200, a dividing unit 300, a content feeding unit, a bag pulling unit 400, a longitudinally sealing unit 500, a transversally sealing unit 600, a cutting unit 700, and the bag forming device 100 as described above. The film feeding unit 200, the dividing unit 300, the bag forming device 100, the bag pulling unit 400, the longitudinally sealing unit 500, the transversally sealing unit 600, and the cutting unit 700 are located in sequence along the feeding direction of the film 8. The content feeding unit is used to feed the content to the forming tube 31 of the bag forming device 100.

The film feeding unit 200 is used to unwind the film roll 8. The dividing unit 300 is used to divide the film 8 obtained from the film feeding unit 200 into film straps 82. The film straps 82 are fed into each of the bag forming device 100 and orientated and folded. The longitudinally folded film is forced to move downward by the bag pulling unit 400 and longitudinally sealed by the longitudinally sealing unit 500 and transversally sealed by the transversally sealing unit 600. To form a packaging bag, the longitudinally sealing unit 500 is used to longitudinally seal sides of the film 8 and the transversally sealing unit 600 is used to transversally seal the film in order to form a chamber for receiving the content. When the chamber is filled with content through the forming tube 31, the film moves and is transversally sealed again by the transversally sealing unit 600 to form an enclosed bag which is then cut out by the cutting unit 700.

According to requirements, the bag forming device 100 can use with continuous or batch-type bag pulling unit. Correspondingly, the longitudinally sealing unit 500 and the transversally sealing unit 600 can work, in a continuous way or in batch, with the bag pulling unit 400.

Figure 14:
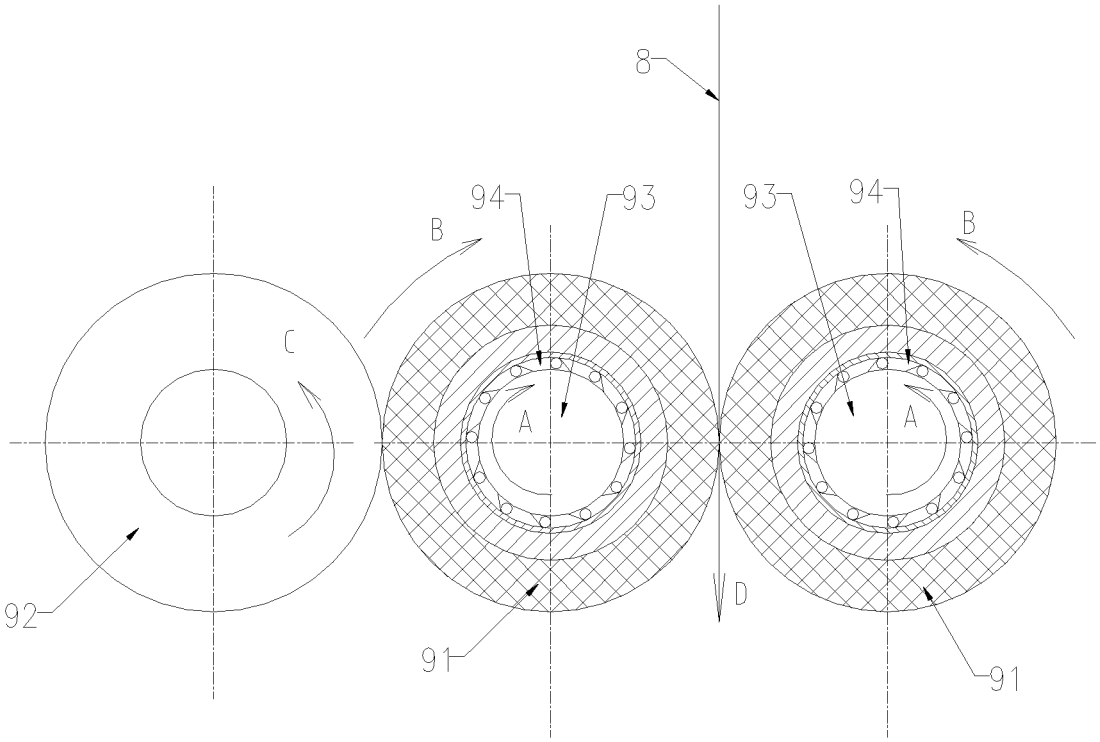
FIG. 14 shows the structure of the compensating mechanism in the bag pulling unit in the packaging machine.

Preferably, as shown in FIG. 14, the bag pulling unit 400 is a continuous bag pulling unit and comprises two parallel spindles 93, at least two roller assemblies corresponding to each of the bag forming mechanism, and an actuator. The spindles have axis in the X direction. Each of the roller assemblies has two bag pulling rollers 91 and one compensating roller 92 in contact with one of the bag pulling rollers 91. The actuator is used to actuate the rotations of the compensating roller 91 and the spindles 93. Each of the bag pulling rollers 91 is mounted to the corresponding spindle via a one-way bearing 94.

The film 8, after folded, passes between the two bag pulling rollers 91 and is actuated to move downward by the two rollers. In operation, the spindle is rotated in A direction so that the bag pulling device 91 is rotated in B direction via the one-way bearing 94. Therefore, the film 8 is actuated to move in D direction.

The compensating roller 92 is rotated by the actuator at a linear velocity higher than that of the spindle 93 (i.e., the bag pulling roller 91) such that the compensating roller 92 applies a friction force to the bag pulling roller 91. When the friction force is larger than the tensile force of the film 8, the rotation of the bag pulling roller 91 will be accelerated. On the other hand, when the friction force is less than the tensile force of the film 8, the compensating roller 92 will slide with the bag pulling roller 91 and the latter will not change its velocity.

Therefore, during operation, when a plurality of packaging film 8 is moved downwardly and if one or some of the film 8 is loose, i.e., the film has less tensile force, the corresponding bag pulling roller 91 will has a higher rotation speed than other bag pulling rollers, causing the film 8 to move more quickly. When the film 8 is tensioned and moved synchronously with other film, the tensile force of the film is increased until the friction force is less than the tensile force, the compensating roller 92 will slide with the bag pulling roller 91 and the compensation is stopped.

Preferably, the friction force can be adjusted by the adjustment of the press force of the compensating roller 92 applied to the bag pulling roller 91. The existence of the compensating roller 92 enables each of the film 8 to move synchronously, eliminating the risk that the film is wound together due to differences in tension, which otherwise may cause failure in bag forming.

It should be understood that various example embodiments have been described with reference to the accompanying drawings in which only some example embodiments are shown. The present invention, however, may be embodied in many alternate forms and should not be construed as limited to only the example embodiments set forth herein.

What is claimed is:

1. A bag forming device, comprising at least two bag forming units, each bag forming unit being provided for passing through a packaging film, wherein each bag forming unit comprises a deflection element and a folding element, the folding element comprises a forming tube, the forming tubes of the bag forming units are arranged in a first direction in sequence; the deflection element comprises a first transition element, an inclined transition portion that is arranged above the first transition element, and a second transition element, and the first transition element and the second transition element are distributed in a width direction of the deflection element with the second transition element being closer to the folding element than the first transition element, a front end surface of the inclined transition portion is provided as an inclined transition surface which is in an inclined arrangement, wherein in one bag forming unit, the deflection element, the first transition element, the inclined transition portion, the second transition element, the folding element and the forming tubes in the folding element are configured and arranged such that:

the packaging film is moved from rear of the deflection element to front of the deflection element in a second direction, and when the packaging film is moved around the deflection element, the packaging film moves along the following moving route: from front of the deflection element where the inclined transition surface is located, to one of two side ends of the deflection element where the first transition element is located, to the other side end of the two side ends of the deflection element where the second transition element is located after passing through the first transition element, and then moves downward parallel and opposite to a height direction of the defection element after passing through the second transition element, wherein the two side ends are left side end and right side end of the deflection element and are distributed in the width direction of the deflection element, and more than one film moving positions are provided in the deflection element in the moving route for passing through of the packaging film to make deflection of the packaging film sequentially, the film moving positions include the inclined transition surface, an outer side surface of the first transition element, and an outer side surface of the second transition element, for successive passing of the packaging film;

wherein the outer side surface of the second transition element and the outer side surface of the first transition element are distributed in the width direction of the deflection element;

wherein from a side end of the inclined transition surface that is close to the outer side surface of the first transition element, to a side end of the inclined transition surface that is close to the outer side surface of the second transition element, the inclined transition surface gradually leans backward;

when the packaging film is moved through the folding element, the packaging film is folded longitudinally, and longitudinal openings of the packaging films after longitudinal folding all face towards the first direction, and the packaging film moves along an axial direction of the forming tube when the packaging film is moving through the forming tube, and wherein the height direction of the deflection element is perpendicular to the first direction and the second direction is perpendicular to the first direction and the height direction of the deflection element.

2. The bag forming device in claim 1, wherein an orthographic projection of the outer side surface of the first transition element in a reference surface formed by the first direction and the second direction is defined as a first projection, and an orthographic projection of the inclined transition surface in said reference surface is defined as a second projection, and an outer side edge of the first projection is located on one side of the second projection.

3. The bag forming device in claim 1, wherein the second transition element and the first transition element are both extended in the second direction, the height direction of the deflection element is perpendicular to the first direction, and the second direction is perpendicular to both the first direction and the height direction of the deflection element, and wherein the inclined transition portion, the first transition element and the second transition element are arranged sequentially in the height direction.

4. The bag forming device of claim 1, wherein the bag forming device comprises at least two deflection plates arranged in the first direction; deflection elements are disposed at both sides of each of the deflection plates in the first direction; inclined transition portions are formed on the deflection plate with inclined transition surfaces symmetrically distributed; the deflection plates and corresponding two deflection elements jointly form a deflection unit, and all deflection units are arranged in the first direction with any of two adjacent units staggered placed in height direction; forming tubes corresponding to two deflection elements in a same deflection unit are arranged on an adjacent side of the two deflection elements.

5. The bag forming device of claim 4, wherein the bag forming device further comprises a path adjustment mechanism, and the packaging film passes through the path adjustment mechanism before being fed into the bag forming unit; the path adjustment mechanism comprises a bracket, a stationary roller disposed on the bracket, and a movable roller movably disposed on the bracket; and the stationary roller is extended in the first direction.

6. The bag forming device of claim 1, wherein the deflection elements are arranged in the first direction in sequence, and two adjacent deflection elements are staggered in height direction.

7. The bag forming device of claim 1, wherein the folding element further comprises limiting members; the limiting members have film passages; the film passages includes an arc-shaped groove for passing through of the forming tubes and a bar-shape position-limiting portion communicative with the arc-shaped groove; and the position-limiting portion is extended in the first direction.

8. A packaging machine comprising a film feeding unit, a dividing unit, a content feeding unit, a bag pulling unit, a longitudinally sealing unit, a transversally sealing unit, a cutting unit, and the bag forming device of claim 1, wherein the film feeding unit, the dividing unit, the bag forming device, the bag pulling unit, the longitudinally sealing unit, the transversally sealing unit, and the cutting unit are located in sequence along the feeding direction of the film, and the content feeding unit is used to feed the content to the forming tube of the bag forming device.

9. The packaging machine of claim 8, wherein the bag pulling unit comprises two parallel spindles, at least two roller assemblies corresponding to each of the bag forming unit, and an actuator; the spindles have axis in the first direction; each of the roller assemblies has two bag pulling rollers and one compensating roller in contact with one of the bag pulling rollers; the actuator is used to actuate the rotations of the compensating roller and the spindles; each of the bag pulling rollers is mounted to the corresponding spindle via a one-way bearing; and the film, after folded, passes between the two bag pulling rollers and is moved downward by the two bag pulling rollers.

10. The packaging machine of claim 8, wherein the bag pulling unit comprises two parallel spindles, at least two roller assemblies corresponding to each of the bag forming unit, and an actuator; the spindles have axis in the first direction.

11. The bag forming device in claim 1, wherein the first transition element and the second transition element are located at the same side of the folding element and spaced from each other in the first direction.

12. The bag forming device in claim 1, wherein adjacent two of the longitudinal openings of the packaging films after longitudinal folding are opposite to each other.

13. The bag forming device in claim 1, wherein each bag forming unit further comprises a limiting member with a film passage for passing through of the folding tube and the packaging film, after the packaging film passes the limiting member the packaging film is longitudinally folded into a U shape with a longitudinal opening facing towards the first direction.

14. The bag forming device in claim 1, wherein a front end surface of the inclined transition portion is provided as an inclined transition surface, the film moving positions include the inclined transition surface, an outer side surface of the first transition element, and an outer side surface of the second transition element, said outer side surface of the second transition element and said outer side surface of the first transition element being spaced from each other in the width direction of the deflection element;

wherein when the packaging film is moved around the deflection element, the packaging film changes directions of its motion at the inclined transition surface, the outer side surface of the first transition element, and the outer side surface of the second transition element sequentially.

* * * * *